United States Patent [19]

Umezaki

[11] Patent Number: 4,985,984

[45] Date of Patent: Jan. 22, 1991

[54] IGNITION COIL FOR INTERNAL COMBUSTION ENGINE

[75] Inventor: Tomokazu Umezaki, Hogyo, Japan

[73] Assignee: Mitsubishi Denki Kabushiki Kaisha, Tokyo, Japan

[21] Appl. No.: 219,154

[22] PCT Filed: Dec. 21, 1987

[86] PCT No.: PCT/JP87/01003

§ 371 Date: Jun. 27, 1988

§ 102(e) Date: Jun. 27, 1988

[30] Foreign Application Priority Data

Dec. 26, 1986 [JP] Japan ..... 61-203245

[51] Int. Cl.[5] ..... H01F 41/02; H01F 27/04

[52] U.S. Cl. ..... 29/602.1; 336/96; 336/107; 336/192

[58] Field of Search ..... 336/96, 105, 107, 192, 336/198; 29/602.1, 605, 606; 264/272.19

[56] References Cited

U.S. PATENT DOCUMENTS 4,408,176 10/1983 Nakamura ..... 336/107
4,803,454 2/1989 Umezaki ..... 336/192

FOREIGN PATENT DOCUMENTS 59-194411 11/1984 Japan ..... 336/96
61-1709 1/1986 Japan ..... 336/96

OTHER PUBLICATIONS

Japanese Patent Public Disclosure (Kohkai) No. 194411/1984.
Japanese Utility Model Publication (Kohkoku) No. 1709/1986.

*Primary Examiner*—Thomas J. Kozma
*Attorney, Agent, or Firm*—Wolf, Greenfield & Sacks

[57] ABSTRACT

The invention relates to an ignition coil for use in an ignition apparatus of an internal combustion engine. For the purpose of miniaturization of the apparatus, a high voltage terminal (13) is integrally constructed by insertion molding the high voltage terminal to a bobbin (11) of a secondary coil portion (10). One end of a secondary winding (12) in the secondary coil portion (10) is soldered and connected to a connecting portion (13*a*) of the high voltage terminal (13). A projecting portion (11*b*) of the bobbin (11) is inserted into an engaging portion (14*b*) of a casing (14). Soldering of the high voltage terminal (13) and secondary winding (12) in the casing (14) is thus unnecessary, allowing the casing (14) to be miniaturized.

27 Claims, 2 Drawing Sheets

IGNITION COIL FOR INTERNAL COMBUSTION ENGINE

TECHNICAL FIELD

The present invention relates to improvement of an ignition coil adapted to generate high voltage for supply to an ignition apparatus of an internal combustion engine.

BACKGROUND ART

FIGS. 1 and 2 are a vertical sectional view and a side elevational view, respectively, showing this kind of conventional ignition coil. In the diagrams, reference numeral 1 denotes an iron core and 2 indicates a primary coil portion arranged around the outer periphery of the iron core 1. The primary coil portion 2 comprises a cylindrical bobbin portion 2*a* made of a resin and a primary winding 2*b* wound around the outer periphery of the bobbin portion 2*a*. Reference numeral 3 denotes a secondary coil portion arranged around the outer periphery of the primary coil portion 2. The secondary coil portion 3 comprises a cylindrical bobbin portion 3*a* made of a resin and a secondary winding 3*c* wound in a winding groove 3*b* formed in the outer periphery of the bobbin portion 3*a*. Reference numeral 4 denotes a pin-shaped high voltage terminal. The end of the secondary winding 3*c* is connected to a head portion 4*a* of the terminal 4. Reference numeral 5 denotes a casing made of a synthetic resin. The casing 5 comprises a hole portion 5*a* into which a high voltage cord (not shown) is inserted, and a casing main body portion 5*b* which encloses the iron core 1, primary coil portion 2 and secondary coil portion 3. Reference numeral 6 denotes a thermosetting resin which is injected in a liquid state into the casing main body portion 5*b* and is then hardened, thereby insulatively fixing the primary coil portion 2, secondary coil portion 3 and the like in the casing 5. Reference numerals 7*a* and 7*b* denote a power source side lead wire and a ground side lead wire, respectively, which consist of coated electric wires that penetrate the rear edge portion of the primary bobbin 2*a*. These lead wires 7*a* and 7*b* are connected to the primary winding 2*b* by soldering and are fixed in the casing 5 by the thermosetting resin 6. Thus, a transformer is constituted by laminating the iron core 1, primary coil portion 2 and secondary coil portion 3. The beginning of the primary winding 2*b* is connected to the ground side lead wire 7*b*. The end of the primary winding 2*b* and the beginning of the secondary winding 3*c* are connected to the power source side lead wire 7*a*. On the other hand, in order to connect an end 3*d* of the secondary winding 3*c* to a high voltage cord (not shown), the winding end 3*d* is connected by means of soldering to the head portion 4*a* of the high voltage terminal 4 which is previously press-inserted into the casing 5 by making use of a space 8 in the casing main body portion 5*b*. After the windings 2*b* and 3*c*, lead wires 7*a* and 7*b* and high voltage terminal 4 have been connected by way of soldering, the casing 5 is filled with the thermosetting resin 6.

A conventional ignition coil for internal combustion engines is constituted in the manner described above. Hence, after the secondary coil portion 3 has been inserted into the casing 5, the end 3*d* of the secondary winding 3*c* in the secondary coil portion 3 needs to be soldered to the head portion 4*a* of the high voltage terminal 4. Consequently, the space portion 8 needs to be formed to allow the soldering work to be performed.

This raises the problem that the overall size of the ignition coil becomes relatively large. On the other hand, since the distance from an opening 5*c* of the casing 5 to the head portion 4*a* of the high voltage terminal 4 is fairly great, there is also a problem in that the soldering work is difficult and the productivity of a mass production process therefore suffers.

The present invention has been achieved with a view to solving the foregoing problems and it is an object of the invention to obtain an ignition coil for use in internal combustion engines which can be miniaturized and offers high productivity gains when applied to a mass production process.

DISCLOSURE OF INVENTION

The present invention provides an ignition coil for internal combustion engines in which a high voltage terminal is formed at the end of a bobbin portion of a secondary bobbin by an insertion molding and this end portion is constituted so as to be fitted into a casing, thereby enabling the secondary coil and high voltage terminal to be easily soldered.

According to the invention, since the high voltage terminal is constituted integrally with the secondary bobbin, the end portion of the coil wound around the secondary bobbin is soldered to the high voltage terminal and, thereafter, when enclosed in the casing, the secondary coil portion can be positioned by engagement between the resin portion and the engaging portion of the casing. Thus, soldering work in the casing becomes unnecessary and the space that has previously been provided for this soldering work can also be dispensed with, thus allowing miniaturization to be realized.

BEST MODE FOR CARRYING OUT THE INVENTION

To understand the present invention in further detail, an explanation will now be given with reference to the drawings.

Figure 1:
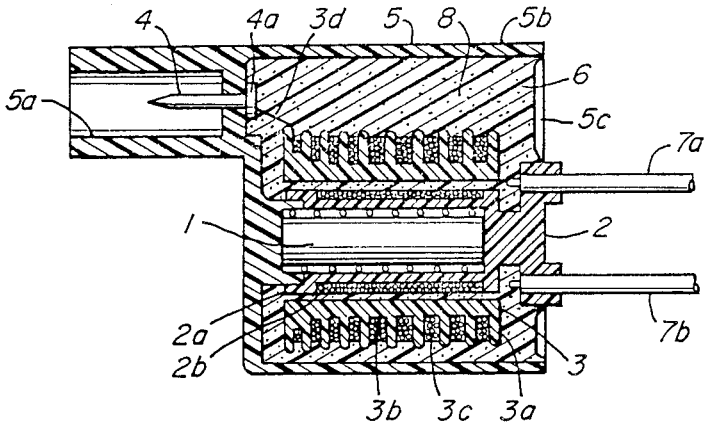
Fig. 1 (PRIOR ART)
FIG. 1 is a vertical sectional view showing a conventional ignition coil for internal combustion engines.
Figure 2:
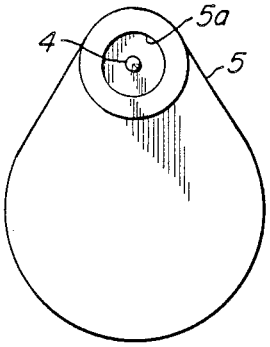
Fig. 2 (PRIOR ART)
FIG. 2 is a side elevational view of the ignition coil shown in FIG. 1.
Figure 3:
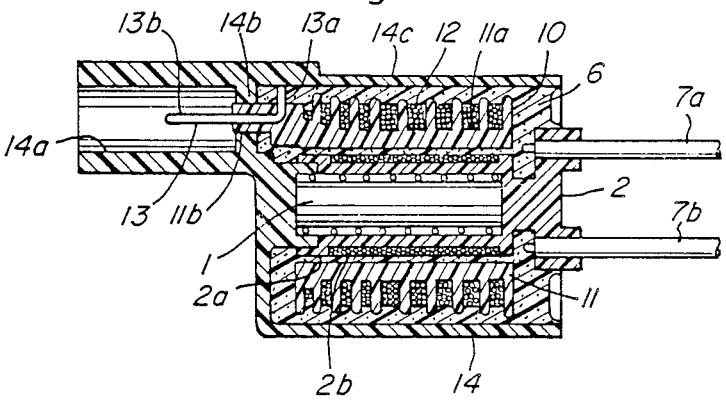
FIG. 3 is a vertical sectional view showing an ignition coil for internal combustion engines as an embodiment of the present invention.
Figure 4:
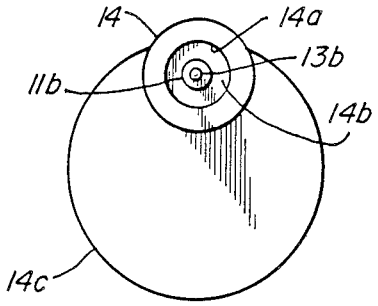
FIG. 4 is a side elevational view of the ignition coil shown in FIG. 3.
Figure 5:
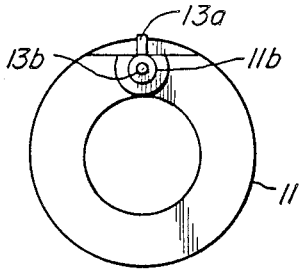
FIG. 5 is a side elevational view of the main section of the ignition coil shown in FIG. 3.

FIGS. 3, 4 and 5 show an ignition coil for internal combustion engines as an embodiment of the invention. In the diagrams, the portions corresponding to those in FIGS. 1 and 2 are designated by the same reference numerals and descriptions thereof are omitted. Reference numeral 10 denotes a secondary coil portion arranged around the outer periphery of the primary coil portion 2. The secondary coil portion 10 comprises: a bobbin 11 formed by molding a synthetic resin like a cylinder; a secondary winding 12 wound around the bobbin 11 in grooves 11*a* formed on the outer periphery surface of the bobbin 11; and a high voltage terminal 13 attached to a projecting portion 11*b* which is formed by extending a portion of one edge surface of the bobbin 11. The high voltage terminal 13 is formed by bending a steel wire into an L-shape. When the bobbin 11 is molded, this bent portion is embedded in and attached to the projecting portion 11*b*. The high voltage terminal 13 is formed with a connecting portion 13*a* which projects from the projecting portion 11*b* in the radial direction and a connecting portion 13*b* which projects in the axial direction. Reference numeral 14 denotes a casing adapted to enclose the iron core 1, primary coil portion 2 and secondary coil portion 10. The casing 14 comprises: a hole portion 14*a* in which the connecting portion 13*b* of the high voltage terminal 13 is arranged and into which a high voltage cord (not shown) is inserted; an engaging portion 14*b* which is provided in the deep portion of the hole portion 14*a* and into which the projecting portion 11*b* of the bobbin 11 is inserted; and a casing main body 14*c* which is formed such that the inner diameter is slightly larger than the outer diameter of the bobbin 11.

The ignition coil for internal combustion engines with such a structure is manufactured by the following steps. First, the high voltage terminal 13 is insertion molded and the bobbin 11 of the secondary coil portion 10 is formed. The secondary winding 12 is wound around the bobbin 11 in the outer peripheral grooves 11*a* thereof. The end portion of the secondary winding 12 is soldered and connected to the connecting portion 13*a* of the high voltage terminal 13. Next, the iron core 1 and primary coil portion 2 are combined. The starting portions of the primary and secondary windings 2*b* and 12 are soldered and connected to the lead wires 7*a* and 7*b* which penetrate the rear edge of the bobbin portion 2*a* of the primary coil portion 2. This assembly is then inserted into the casing main unit 14*c*. The connecting portion 13*b* projected in the axial direction of the high voltage terminal 13 is arranged in the hole 14*a* of the casing 14. The projecting portion 11*b* of the bobbin 11 comes into engagement with the engaging portion 14*b*. At this time, the connecting portion 13*b* of the high voltage terminal 13 is first inserted into the engaging portion 14*b*. Thus, the casing 14 and secondary coil portion 10 can be positioned to a certain extent, thereby facilitating the assembly work. After completion of the assembly as mentioned above, the thermosetting resin 6 is charged into the casing main unit 14*c* and hardened to complete the manufacture of an ignition coil. By engaging the projecting portion 11*b* with the engaging portion 14*b*, the thermosetting resin 6 prevents any outflow to the side of the hole portion 14*a*. In this manner, by insertion molding the high voltage terminal 13 integrally with the bobbin 11 of the secondary coil portion 10, soldering work in the casing 14 becomes unnecessary and the manufacturing efficiency is improved. Also, the outer shape of the casing 14, i.e., the overall size of the ignition coil, can be miniaturized. In addition, for the high voltage terminal 13, a steel wire can be molded and worked into an L-shape simultaneously with the cutting operation. Further, by miniaturizing the casing 14, the amount of thermosetting resin 6 needed to fill it can be reduced. This offers the advantage that the apparatus can be constructed at a reduced cost.

It is to be noted that a conductive metal having rigidity can be used as the high voltage terminal 13 and that it is not necessary to use steel wire.

As described above, according to the present invention, since the high voltage terminal is constituted by insertion molding in the bobbin of the secondary coil portion, soldering work in the casing is unnecessary and the volume of space provided in the casing can hence be reduced. A small-sized ignition coil of reasonable cost can thus be obtained.

What is claimed is:

1. A method of fabricating an ignition coil for an internal combustion engine comprising the steps of: providing an iron core, a primary coil portion arranged about the iron core, a secondary coil portion arranged about the primary coil portion, a casing made of a synthetic resin adapted to enclose the iron core, the primary coil portion and the secondary coil portion and including an engaging portion having a hole, and a thermosetting resin which is charged into the casing and hardened, thereby fixing the iron core, the primary coil portion and the secondary coil portion, providing a high voltage terminal and a bobbin with a projecting portion as part of the secondary coil portion, said high voltage terminal having at least one connecting portion, forming the one connecting portion of the high voltage terminal in at least the projecting portion of the bobbin, and inserting the projecting portion of the bobbin into the engaging portion of the casing with said connecting portion and said projecting portion extending into said hole and said engaging portion engaging said projecting portion.

2. A method according to claim 1 wherein the high voltage terminal includes at least a second connecting portion, the casing includes a hole portion, and said inserting step comprises inserting the second connecting portion of the terminal into the hole portion of the casing.

3. A method according to claim 1 wherein said forming step comprises integrally forming the one connecting portion of the high voltage terminal with said bobbin by insertion molding thereof with the bobbin.

4. A method according to claim 1, further comprising soldering a secondary winding, included with the secondary coil portion, to the high voltage terminal.

5. A method of fabricating an ignition coil for an internal combustion engine comprising the steps of: providing an iron core, a primary coil portion arranged about the iron core, a secondary coil portion arranged about the primary coil portion, a casing made of a synthetic resin adapted to enclose the iron core, the primary coil portion and the secondary coil portion and including an engaging portion having a hole, and a thermosetting resin which is charged into the casing and hardened, thereby fixing the iron core, the primary coil portion and the secondary coil portion, providing a high voltage terminal and a bobbin with a projecting portion as part of the secondary coil portion, said high voltage terminal having at least one connecting portion, forming the one connecting portion of the high voltage terminal in the projecting portion of the bobbin, wherein said step of providing the iron core, the primary coil portion and the secondary coil portion comprises inserting the projecting portion of the bobbin into the engaging portion of the casing with said connecting portion and said projecting portion extending into said hole and said engaging portion engaging said projecting portion.

6. A method according to claim 5, wherein:

said step of providing a bobbin and a high voltage terminal comprises forming the high voltage terminal substantially in an L-shape; and said forming step comprises embedding the one connecting portion of the high voltage terminal in the projecting portion of the bobbin.

7. A method for fabricating an ignition coil, comprising the steps of:

forming a bobbin with a projecting portion, comprising integrally forming a first portion of a conductor in at least the projecting portion of the bobbin;

first inserting a ferromagnetic core, a primary coil portion arranged about the core, and a secondary coil portion arranged about the primary coil portion and including the bobbin, into a casing including an engaging portion, said first inserting step comprising inserting the projecting portion of the bobbin into the engaging portion of the casing for engagement between the projecting and engaging portions with said first portion of a conductor and said projecting portion extending into said hole; and after said first inserting step, inserting and hardening in the casing a material, thereby fixing the ferromagnetic core, the primary coil portion and the second coil portion in the casing.

8. A method according to claim 7 wherein:

the conductor includes a second portion;

the casing includes a hole portion; and said first inserting step comprises inserting the second portion into the hole portion.

9. A method according to claim 7 wherein:

said forming step comprises integrally forming the first portion of the conductor with at least the projecting portion of the bobbin by insertion molding the bobbin with a portion thereof about the first portion of the conductor.

10. A method according to claim 7 wherein said forming step comprises:

soldering a secondary winding, included with the secondary coil portion, to the conductor.

11. A method according to claim 7 wherein:

said forming step comprises forming the bobbin with the projecting portion thereof projected in an axial direction from an end surface of the bobbin; and said first inserting step comprises axially inserting the projecting portion of the bobbin into the engaging portion of the casing.

12. A method according to claim 7 wherein:

said method further comprises, prior to said forming step, forming the conductor substantially in an L-shape; and said step of forming the bobbin comprises embedding the first portion of the conductor in at least the projecting portion of the bobbin.

13. A method for fabricating a coil, comprising the steps of:

forming a bobbin with a conductor at least partially inserted therein and extending therefrom such that at least a portion of the bobbin is disposed about at least part of the conductor;

assembling together a ferromagnetic core, a primary coil portion, and a secondary coil portion including the bobbin, to produce an assembly thereof;

forming a casing comprising a first portion of sufficient size to accommodate the assembly, and an engaging portion having a hole; and inserting the assembly into the first portion of the casing such that the conductor extends into the hole of the engaging portion, and the bobbin portion about the at least part of the conductor extends into said hole and engages the engaging portion of the casing.

14. A method according to claim 13 wherein:

said step of forming the bobbin comprises forming the bobbin with the bobbin portion about at least part of the conductor comprising a projecting portion about at least part of the inserted portion of the conductor;

said step of forming the casing comprises forming the casing with the engaging portion being configured to engage the projecting portion; and said inserting step comprises engaging the projecting portion and the engaging portion.

15. A method according to claim 13, further comprising the steps of:

after said step of forming the bobbin, winding a wire around the bobbin; and after said winding step, connecting one end of the wire to the conductor, whereby the secondary coil portion is formed.

16. A method according to claim 15 wherein said assembling step comprises connecting the wire to a wire of the primary coil portion.

17. A method according to claim 13, further comprising the step of:

after said inserting step, inserting and hardening a material in the first portion of the casing such that the primary and secondary coil portions are substantially fixed in place in the casing.

18. A method according to claim 17 wherein said inserting and hardening step comprises inserting and hardening in the casing a thermosetting material.

19. A method according to claim 13 wherein said step of forming the bobbin comprises insertion molding the at least part of the conductor in the bobbin.

20. A method according to claim 13, further comprising the step of:

before said step of forming the bobbin, forming the conductor substantially in an L-shape.

21. A method according to claim 20 wherein said step of forming the bobbin comprises:

forming the bobbin by molding a material; and embedding in the material a first portion of the conductor including the bend of the L-shape.

22. A method according to claim 21 wherein said assembling step comprises disposing the conductor with at least part of the first conductor portion including the bend being disposed in the first casing portion, and with a second conductor portion extending from the bobbin being at least partially disposed in the engaging portion of the casing.

23. A method according to claim 22 wherein:

said embedding step comprises embedding in the material the first portion of the conductor with a third portion of the conductor, on the opposite side of the bend from the second conductor portion, extending from the bobbin after molding; and said assembling step comprises disposing the conductor with the third conductor portion being disposed in the first casing portion.

24. A method according to claim 1, wherein:

said step of providing a bobbin and a high voltage terminal comprises forming the high voltage terminal substantially in an L-shape; and said forming step comprises embedding the one connecting portion of the high voltage terminal in the projecting portion of the bobbin.

25. A method according to claim 5 wherein the projecting portion of the bobbin is projected in an axial direction from an end surface of the bobbin, and said inserting step comprises axially inserting the projecting portion of the bobbin into the engaging portion of the casing.

26. A method according to claim 13 wherein:

said step of forming the casing comprises forming a hole portion, adjacent the engaging portion, of sufficient size to accommodate at lest one dimension of the conductor; and said inserting step comprises inserting the assembly into the first portion of the casing such that the conductor extends through the engaging portion into the hole portion.

27. A method according to claim 20 wherein said step of forming the bobbin comprises:

forming the bobbin by molding a material; and during molding of the bobbin, embedding in the material a first portion of the conductor including the bend of the L-shape.

* * * * *